US007611383B1

(12) United States Patent
Huang

(10) Patent No.: US 7,611,383 B1
(45) Date of Patent: Nov. 3, 2009

(54) RJ45 CONNECTOR DEVICE HAVING KEY STRUCTURE FOR CHANGING PIN DEFINITIONS

(75) Inventor: Wen Chin Huang, Taipei (TW)

(73) Assignee: Moxa, Inc., Taipei (TW)

( * ) Notice: Subject to any disclaimer, the term of this patent is extended or adjusted under 35 U.S.C. 154(b) by 0 days.

(21) Appl. No.: 12/318,072

(22) Filed: Dec. 22, 2008

(51) Int. Cl.
*H01R 13/66* (2006.01)

(52) U.S. Cl. ..... 439/620.17

(58) Field of Classification Search ..... 439/188, 439/620.17, 620.22, 620.23
See application file for complete search history.

(56) References Cited

U.S. PATENT DOCUMENTS 5,700,167 A * 12/1997 Pharney et al. ..... 439/676
6,371,780 B1 * 4/2002 Aponte et al. ..... 439/188
7,230,192 B2 * 6/2007 Loeffelholz et al. ..... 200/51.09
RE40,375 E * 6/2008 Abel et al. ..... 439/188

* cited by examiner

*Primary Examiner*—Phuong K Dinh
(74) *Attorney, Agent, or Firm*—Bacon & Thomas, PLLC

(57) ABSTRACT

An RJ45 connector device having a key structure for changing pin definitions is provided. The RJ45 connector device includes a conversion processor, a key, an information processor, and output pins. When the key is pressed to trigger a conversion signal, the conversion processor first converts a part of input information into relay information. Then, according to the conversion signal, the information processor converts the input information and the relay information into output information through designated processing and then output the output information through the output pins, so as to solve the problem that various connector devices occupy a lot of the available space of an electronic device when being used, thereby saving the available space of the electronic device and enabling a single connector device to achieve technical effects of a multi-functional connector device in terms of switching pin definitions.

11 Claims, 5 Drawing Sheets

RJ45 CONNECTOR DEVICE HAVING KEY STRUCTURE FOR CHANGING PIN DEFINITIONS

BACKGROUND OF THE INVENTION

1. Field of Invention

The present invention relates to a connector device, and more particularly, to an RJ45 connector device having a key structure for changing pin definitions.

2. Related Art

Currently, with the rapid development of technologies, more and more products in our daily life have developed from a conventional mechanical analogy control mode into an electronic digital control mode. Thus, various electronic devices or electronic elements are connected to each other through different types of connectors or connector devices, thereby achieving the electrical connection effects. Among various connectors, the common connectors include circular connectors, specification conversion connectors, and so on. As for the connector devices, common connector devices include RJ45 connector devices, USB connector devices, and so on.

As for each type of connectors or connector devices in a different specification, the data read or received via the pins electrically connected to such connectors or connector devices are constant. Thus, when a different data processing function is required, another connector or connector device of a different specification needs to be used, so as to read or receive corresponding data. However, since each type of connectors or connector devices occupy certain space and volume, the more connectors or connector devices are used, the larger space and volume are occupied, which violates a current design concept for an electronic device of being light, thin, short, and small.

Therefore, a single connector or connector device that can achieve functions of many different types of connectors or connector devices is needed. In this way, since only a single connector or connector device is employed, the volume and space occupied by using many different connectors or connector devices can be saved, which not only conforms to the design concept of being light, thin, short, and small, but also saves the materials indirectly.

In view of the above problem in the prior art that various connector devices occupy a lot of the available space of the electronic device when being used, it is necessary to propose an improved technical means to solve such a problem.

SUMMARY OF THE INVENTION

In view of the problem in the prior art that various connector devices occupy a lot of an available space of an electronic device when being used, the present invention is directed to an RJ45 connector device having a key structure for changing pin definitions.

The RJ45 connector device having a key structure for changing pin definitions provided in the present invention includes a base, a conversion circuit board, a set of input pins, a key circuit board, an information processing circuit board, and an output circuit board.

The base has a recess and an accommodation space. A hole is disposed at a position where the recess and the accommodation space are separated from each other. The conversion circuit board is disposed in the accommodation space, and has a conversion processor disposed thereon. The set of input pins are disposed within the recess and is electrically connected to the conversion circuit board. The key circuit board is disposed in the accommodation space, and has a key disposed thereon corresponding to the hole. The key circuit board is electrically connected to the conversion circuit board. The information processing circuit board is electrically connected to the conversion circuit board and has an information processor disposed thereon. The output circuit board is electrically connected to the information processing circuit board and has a set of output pins disposed thereon.

When the key is pressed, a conversion signal is triggered; the conversion processor converts a part of input information input by a designated input pin in the set of input pins into relay information and transfers the relay information, the conversion signal, and the input information into the information processor; and then the information processor converts the input information and the relay information into output information through designated processing according to the conversion signal, and transfers the output information to be output via the set of output pins.

The system and method according to the present invention have been described above. The difference between the present invention and the prior art lies in that, the RJ45 connector device of the present invention includes a conversion circuit board, a key circuit board, an information processing circuit board, and an output circuit board, and when a key on the key circuit board is pressed to trigger a conversion signal, a conversion processor disposed on the conversion circuit board first converts a part of input information input by a designated input pin in the set of input pins into relay information, and then transfers the relay information, the conversion signal, and the input information to the information processor; and the information processor then converts the input information input by the set of input pins and the relay information into output information through designated processing according to the conversion signal, and outputs the output information after being processed by the conversion processor for being output via the set of output pins, so as to switch different pin definitions on a single RJ45 connector device, thereby achieving an effect of a multi-functional connector device.

With the above technical means, the present invention can save the available space of the electronic device and enable a single connector device to achieve technical effects of a multi-functional connector device in terms of switching pin definitions.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

The detailed features and advantages of the present invention will be described in detail in the following embodiments. Those skilled in the arts can easily understand and implement the content of the present invention. Furthermore, the relative objectives and advantages of the present invention are apparent to those skilled in the arts with reference to the content disclosed in the specification, claims, and drawings.

Figure 1:
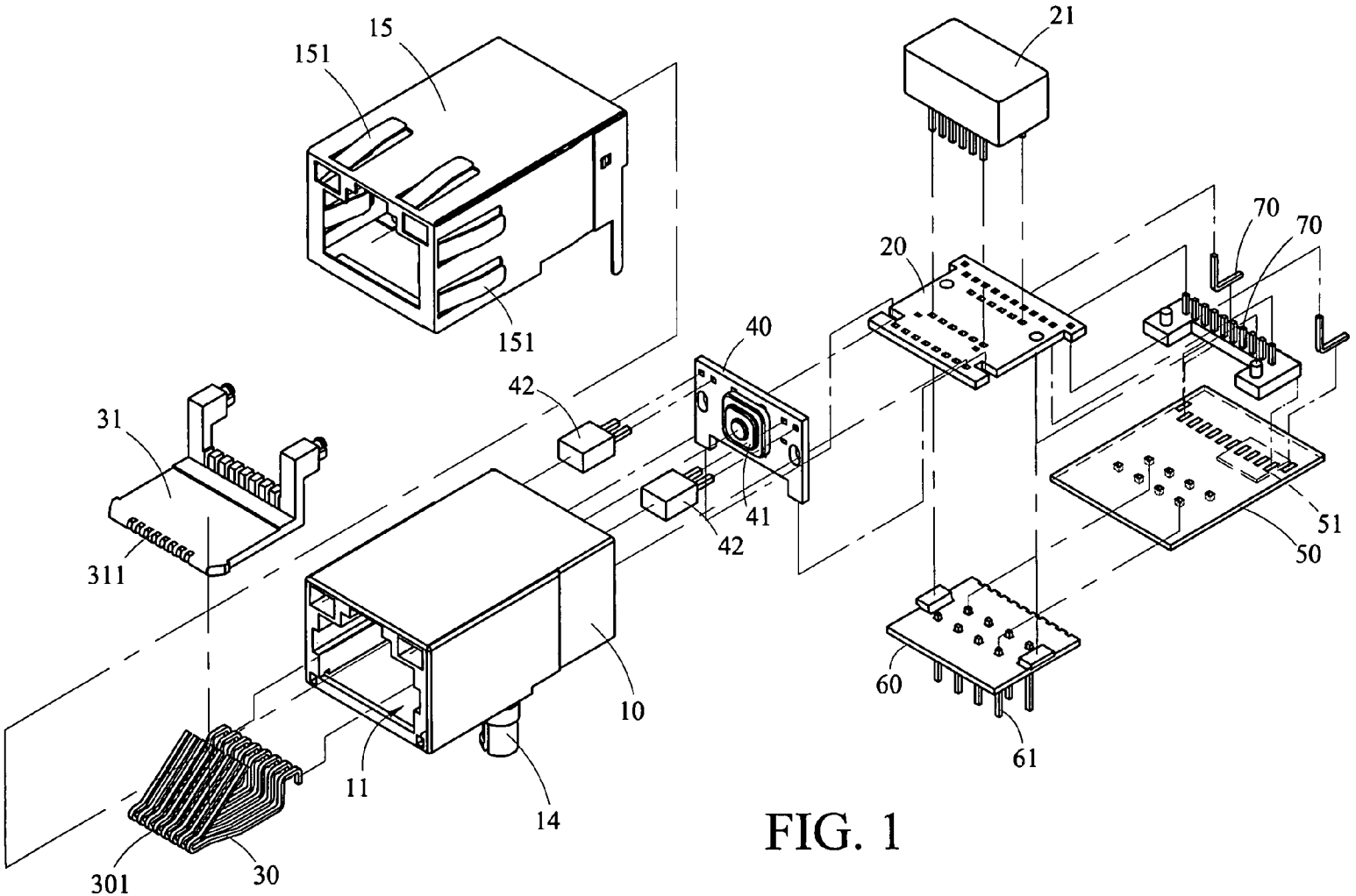
FIG. 1 is a three-dimensional exploded view of an RJ45 connector device having a key structure for changing pin definitions according to the present invention.
Figure 2:
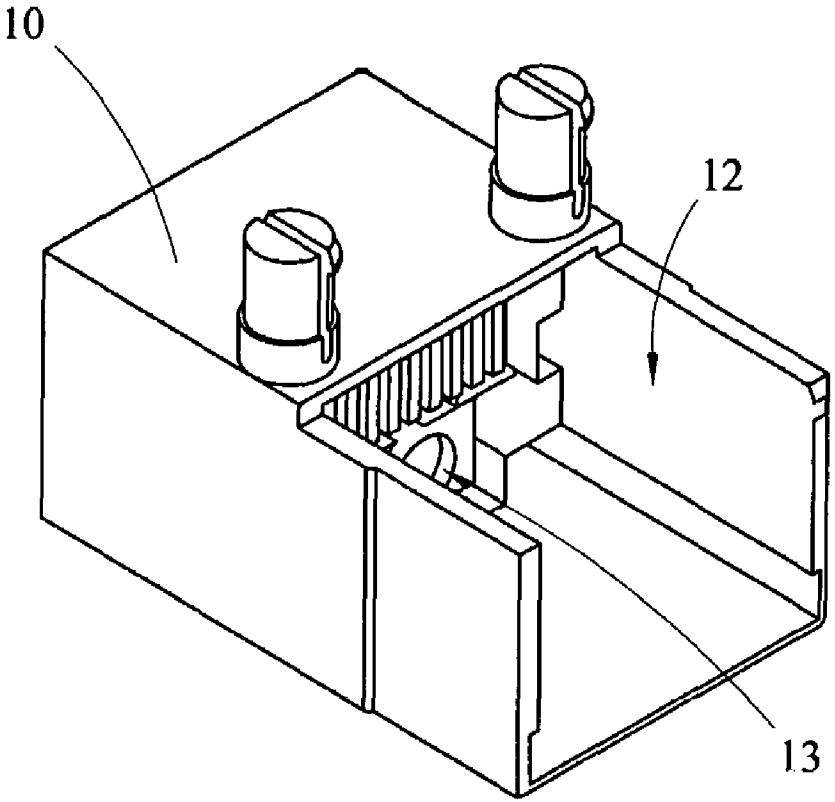
FIG. 2 is a three-dimensional view of a base of an RJ45 connector device having a key structure for changing pin definitions according to the present invention.

An RJ45 connector device having a key structure for changing pin definitions of the present invention is described below. FIG. 1 is a three-dimensional exploded view of an RJ45 connector device having a key structure for changing pin definitions according to the present invention. FIG. 2 is a three-dimensional view of a base of an RJ45 connector device having a key structure for changing pin definitions according to the present invention.

The RJ45 connector device having the key structure to change the pin definition according to the present invention includes a base 10, a conversion circuit board 20, a set of input pins 30, a key circuit board 40, an information processing circuit board 50, and an output circuit board 60.

The base 10 is formed with a recess 11 and an accommodation space 12 through injection molding. The accommodation space 12 (shown in FIG. 2) is used for accommodating the conversion circuit board 20 and the key circuit board 40. A hole 13 (shown in FIG. 2) is disposed at a position where the recess 11 and the accommodation space 12 are separated from each other.

The base 10 may be made of polyphthalamide (PPA) or other thermoplastic resins commonly used for manufacturing the base 10 of the connector device. The base 10 further has at least one positioning element 14, which is used to fix the RJ45 connector device to an external circuit board (not shown) in the electronic device. The base 10 can be fixed to the external circuit board accurately and rapidly by using the relative positions between the positioning elements 14.

In addition, the RJ45 connector device further includes a housing 15 made of a metal or thermoplastic resin. The housing 15 is used for enclosing the base 10 externally. The housing 15 further has at least one positioning part 151. When the RJ45 connector device is disposed on the housing of the electronic device (not shown), the positioning part 151 on the housing 15 of the RJ45 connector device may be used for positioning.

Next, the conversion circuit board 20 is disposed in the accommodation space 12, and has a conversion processor 21 disposed thereon. The conversion processor 21 is used to perform calculations on a part of input information received by the RJ45 connector device, and convert the input information into relay information. The input information is received from an external electronic device. The information conversion process of the conversion processor 21 will be illustrated below in detail.

Then, the set of input pins 30 are disposed in the recess 11. The set of input pins 30 may be directly buried in the base 10 while the base 10 is injection molded. Alternatively, the set of input pins 30 are disposed in the recess 11 after the base 10 has been injection molded. Then, a cover plate 31 covers the set of input pins 30 (such a connection manner is depicted in the drawing, but the present invention is not limited thereto), so that the set of input pins 30 are electrically connected to the external RJ45 connector device. The set of input pins 30 are electrically connected the conversion circuit board 20, so that the conversion processor 21 disposed on the conversion circuit board 20 can receive the input information.

Considering the manner of disposing the set of input pins 30 within the recess 11 through the cover plate 31, a cover front edge 311 of the cover plate 31 is fitted with an inside shape of a pin front edge 301 of the set of input pins 30, and a bottom surface of the cover plate 31 is fitted with a shape of the set of input pins 30. Then, the cover front edge 311 of the cover plate 31 is in contact with an interior of the pin front edge 301 of the set of input pins 30 at an inclination angle. Then, the cover plate 31 is rotated to make the bottom surface of the cover plate 31 in contact with the set of input pins 30, so that the set of input pins 30 can be disposed within the recess 11, and thus the set of input pins 30 are buried within the base 10 through the cover plate 31.

In addition to the conversion circuit board 20, the key circuit board 40 is also disposed in the accommodation space 12 of the base 10. The conversion circuit board 20 is electrically connected to the key circuit board 40, the information processing circuit board 50, and the output circuit board 60 respectively. The information processing circuit board 50 and the conversion circuit board 20 are electrically connected to each other through a set of conversion pins 70. The output circuit board 60 and the information processing circuit board 50 are electrically connected to each other through a set of output pins 61. Therefore, information can be transferred among the different circuit boards.

A key 41 is disposed on the key circuit board 40 and is arranged at a position corresponding to the hole 13 at the poison of the base 10 where the recess 11 and the accommodation space 12 are separated from each other. Thus, the key 41 on the key circuit board 40 may be pressed through the recess 11 via the hole 13.

At least one light-emitting diode (LED) 42 may be further disposed on the key circuit board 40. As the key circuit board 40 and the conversion circuit board 20 are electrically connected to each other, a color shown by the LEDs 42 may be controlled by the conversion processor 21 on the conversion circuit board 20. The pin definitions of the RJ45 connector device may correspond to the colors shown by the LEDs 42. One LED can present more than two colors. Through different variations and combinations of colors presented by the LEDs 42, the pin definitions of the RJ45 connector device can be shown.

An information processor 51 is disposed on the information processing circuit board 50. The information processor 51 is used for performing designated processing on the relay information generated after a part of input information received by the RJ45 connector device is processed by the conversion processor 21 and the input information received by the RJ45 connector device according to different conversion signals and converting the relay information and the input information into output information.

The set of output pins 61 are disposed on the output circuit board 60. After the information processor 51 performs computation operations on the relay information and the input information and converts them into the output information, the output information obtained by the information processor 51 may be output via the set of output pins 61 on the output circuit board 60. Furthermore, the set of output pins 61 on the output circuit board 60 are also used for electrically connecting to an external circuit board, so that the external circuit board can receive the processed output information of the RJ45 connector device.

Figure 3:
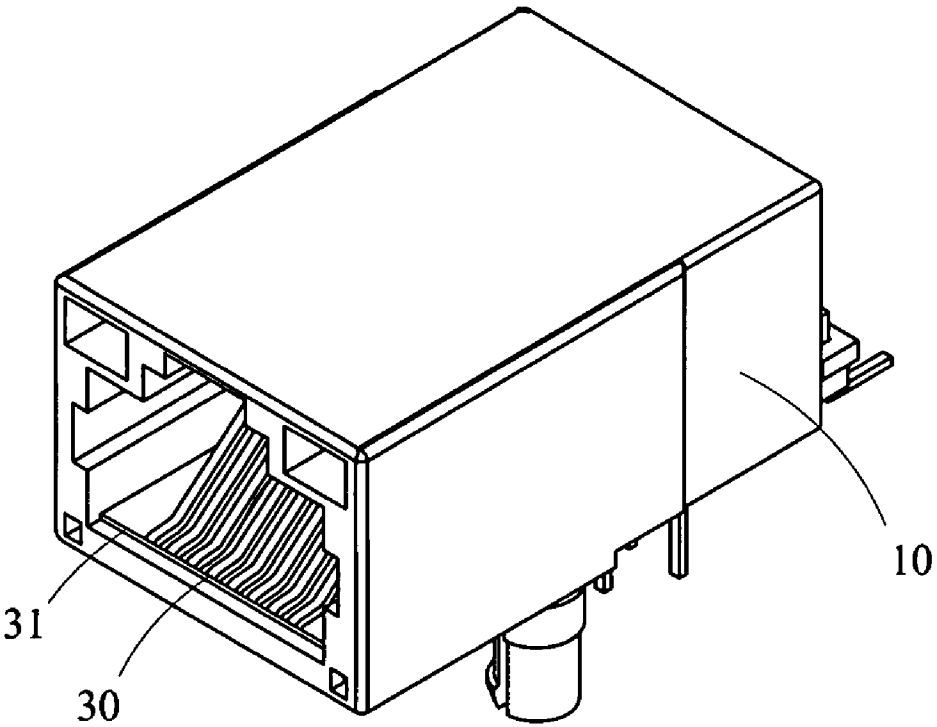
FIG. 3 is a three-dimensional assembly view of an RJ45 connector device having a key structure for changing pin definitions according to the present invention.

The RJ45 connector device after being assembled is shown in FIG. 3. FIG. 3 is a three-dimensional assembly view of an RJ45 connector device having a key structure for changing pin definitions according to the present invention.

Figure 4A:
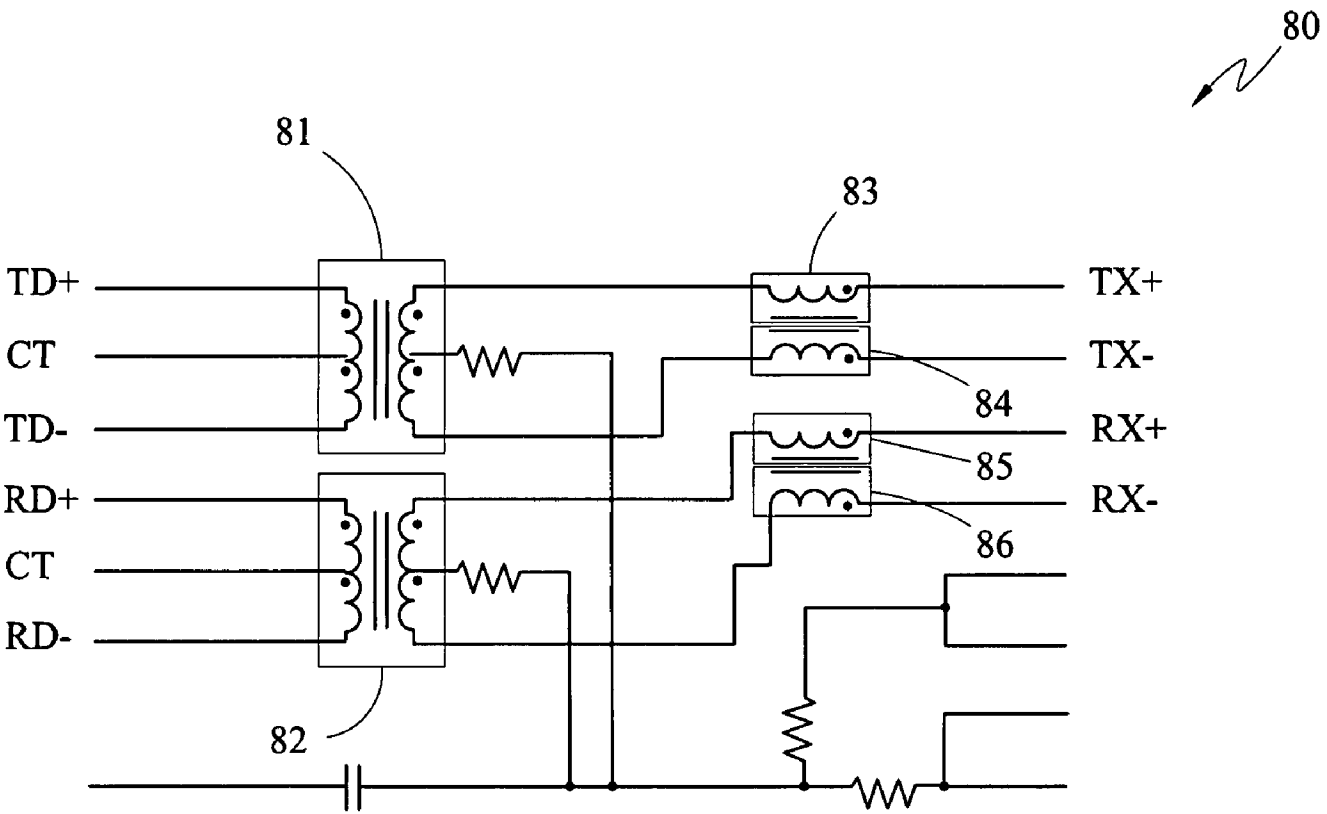
FIG. 4A is a schematic circuit diagram for information processing by a conversion processor in an RJ45 connector device having a key structure for changing pin definitions according to the present invention.

FIG. 4A is a schematic circuit diagram for information processing by a conversion processor in an RJ45 connector device having a key structure for changing pin definitions according to the present invention.

Referring to FIGS. 1 and 4A, in the RJ45 connector device, four pins (TX+, TX−, RX+, and RX−) in the set of input pins 30 are electrically connected to four designated pins of the conversion processor 21 on the conversion circuit board 20 directly. The conversion processor 21 converts a part of the input information received via the four designated pins through a conversion circuit 80.

As shown in the figures, a first transformer element 81, a second transformer element 82, a first sensing element 83, a second sensing element 84, a third sensing element 85, and a fourth sensing element 86 are used in the conversion circuit 80. Based on the circuit shown in FIG. 4A, the four input information TX+, TX−, RX+, and RX− in the set of input pins 30 are converted into six output signals, namely, TD+, TD−, CT, RD+, RD−, and CT, through the conversion circuit 80. The six output signals are the relay information. The relay information is then transferred into the information processor 51.

Figure 4B:
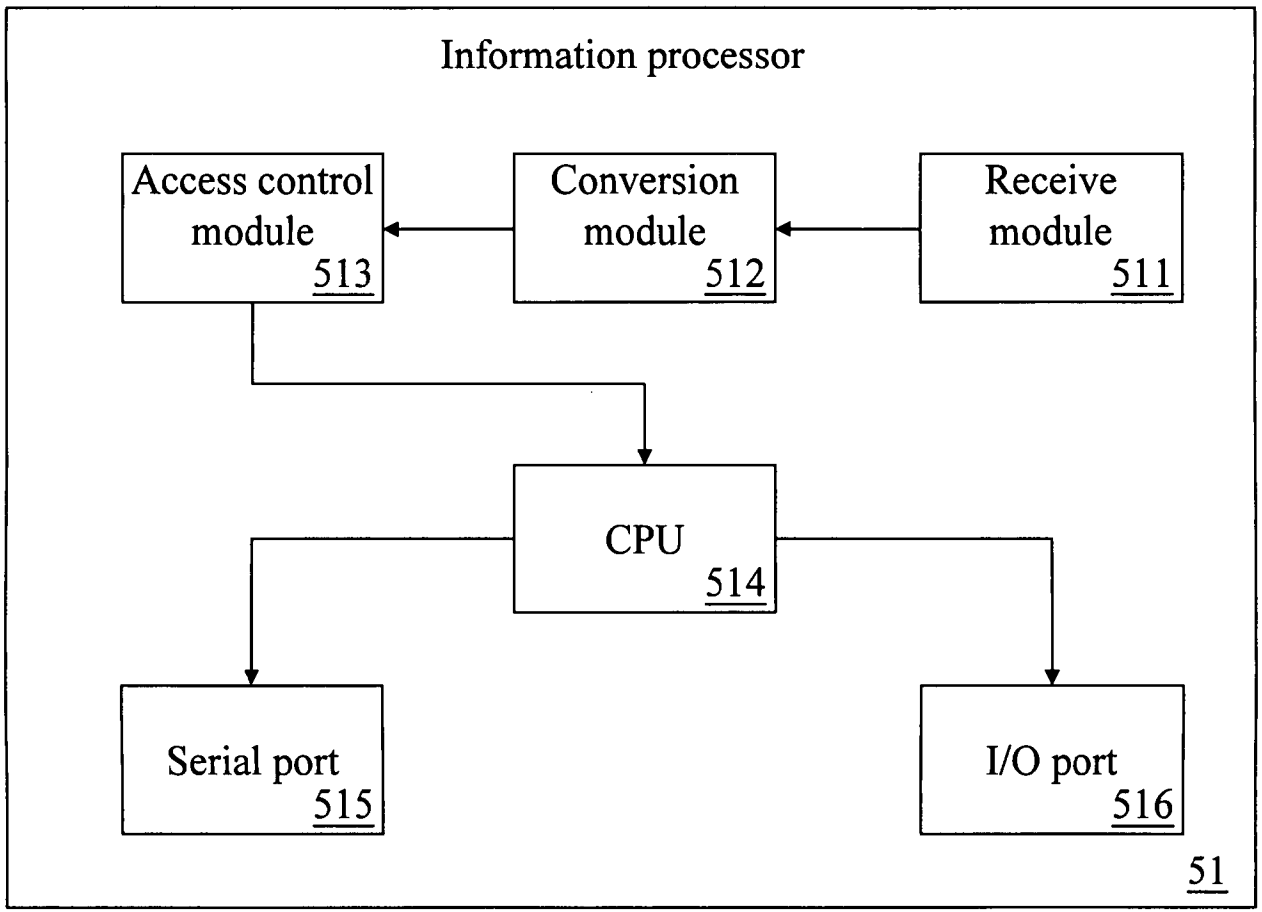
FIG. 4B is a schematic block diagram of an information processing function of an information processor in an RJ45 connector device having a key structure for changing pin definitions according to the present invention.

FIG. 4B is a schematic block diagram of an information processing function of an information processor in an RJ45 connector device having a key structure for changing pin definitions according to the present invention.

Referring to FIG. 1 and FIG. 4B, the information processor 51 receives the relay information (TD+, TD−, CT, RD+, RD−, and CT, referring to FIG. 4A) output from the conversion processor 21 and the input information of the other pins in the set of input pins 30 through a receive module 511. The receive module 511 transfers the received relay information and input information to a conversion module 512. For example, since the present invention uses an RJ45 connector device, the receive module 511 may be an Ethernet port.

The conversion module 512 converts the relay information and the input information into internal information that can be used by an access control module 513. For example, the conversion module 512 may be a physical layer (PHY), and the access control module 513 may be a media access control (MAC) layer, which are both communication elements defined by standards, and will not be described here.

Next, a central processing unit (CPU) 514 performs designated processing on the internal information sequentially through the access control module 513. The CPU 514 divides the internal information into serial information and relay output information, and outputs the serial information via a serial port 515, and outputs the relay output information via an input/output (I/O) port 516.

The serial information output via the serial port 515 are TX, RX, RTS, and CTS of the RS232 signal, and the relay output information output via the I/O port 516 are VCC, GND, Reset, and DIO. These eight outputs are the output information, and may be output via the set of output pins 61. When the RJ45 connector device is electrically connected to the external circuit board, the subsequent data processing may be performed according to the pins defined by the set of output pins 61 and the output information.

In conclusion, when the key 41 on the key circuit board 40 is pressed to trigger the conversion signal, the conversion processor 21 first converts a part of the input information into the relay information, and transfers the relay information to the information processor 51. Then, the information processor 51 performs designated processing on the input information input by the set of input pins 30 and the relay information according to the conversion signal, converts the input information and the relay information into designated output information, and transfers the output information for being output via the set of output pins 61, thereby achieving the effect of switching different pin definitions with a single RJ45 connector device, and meanwhile achieving the technical effects of a multi-functional connector device.

The implementation aspect in the drawings is merely intended for demonstration, but not to limit the applications of the present invention. Any conversion circuit that can achieve a similar function should fall within the scope of the present invention.

To sum up, the difference between the present invention and the prior art lies in that, the RJ45 connector device of the present invention includes a conversion circuit board, a key circuit board, an information processing circuit board, and an output circuit board, and when a key on the key circuit board is pressed to trigger a conversion signal, a conversion processor disposed on the conversion circuit board first converts a part of input information input by a designated input pin in the set of input pins into relay information, and then transfers the relay information, the conversion signal, and the input information to the information processor; and the information processor then converts the input information input by the set of input pins and the relay information into output information through designated processing according to the conversion signal, and outputs the output information after being processed by the conversion processor for being output via the set of output pins, so as to switch different pin definitions on a single RJ45 connector device, thereby achieving an effect of a multi-functional connector device.

With the above technical means, the present invention can save the available space of the electronic device and enable a single connector device to achieve technical effects of a multi-functional connector device in terms of switching pin definitions.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An RJ45 connector device having a key structure for changing pin definitions, comprising:

a base, having a recess and an accommodation space, wherein a hole is disposed at a position where the recess and the accommodation space are separated from each other;

a conversion circuit board, disposed in the accommodation space, wherein a conversion processor is disposed on the conversion circuit board;

a set of input pins, disposed within the recess and electrically connected to the conversion circuit board;

a key circuit board, disposed in the accommodation space, wherein a key is disposed on the key circuit board corresponding to the hole, and the key circuit board is electrically connected to the conversion circuit board;

an information processing circuit board, electrically connected to the conversion circuit board and comprising an information processor; and an output circuit board, electrically connected to the information processing circuit board and comprising a set of output pins;

wherein when the key is pressed, a conversion signal is triggered; the conversion processor converts a part of input information input by a designated input pin in the set of input pins into relay information and transfers the relay information, the conversion signal, and the input information into the information processor; and then the information processor converts the input information and the relay information into output information through designated processing according to the conversion signal, and transfers the output information to be output via the set of output pins.

2. The RJ45 connector device having a key structure for changing pin definitions according to claim 1, wherein the set of input pins are buried within the recess.

3. The RJ45 connector device having a key structure for changing pin definitions according to claim 1, further comprising a cover plate, for covering the set of input pins.

4. The RJ45 connector device having a key structure for changing pin definitions according to claim 1, further comprising at least one light-emitting diode (LED), for indicating pin definitions of the RJ45 connector device.

5. The RJ45 connector device having a key structure for changing pin definitions according to claim 4, wherein the LEDs are electrically connected to the key circuit board.

6. The RJ45 connector device having a key structure for changing pin definitions according to claim 1, wherein the base further comprises at least one positioning element for fixing the base to an external circuit board.

7. The RJ45 connector device having a key structure for changing pin definitions according to claim 1, wherein the set of output pins are used for electrically connecting to an external circuit board.

8. The RJ45 connector device having a key structure for changing pin definitions according to claim 1, further comprising a housing for enclosing the base.

9. The RJ45 connector device having a key structure for changing pin definitions according to claim 8, wherein the housing has at least one positioning part.

10. The RJ45 connector device having a key structure for changing pin definitions according to claim 1, wherein the information processing circuit board and the conversion circuit board are electrically connected to each other through a set of conversion pins.

11. The RJ45 connector device having a key structure for changing pin definitions according to claim 1, wherein the output circuit board and the information processing circuit board are electrically connected to each other through the set of output pins.

* * * * *